US006984901B2

(12) United States Patent
Wong et al.

(10) Patent No.: US 6,984,901 B2
(45) Date of Patent: Jan. 10, 2006

(54) BATTERY-POWERED WASHER

(75) Inventors: Steve Wong, Kowloon Bay (CN); Neville Glenn, Brighton (CA); William Rakocy, Madison, CT (US); David Bean, St. Joseph, MI (US)

(73) Assignee: International Concepts, Inc., St. Joseph, MI (US)

( * ) Notice: Subject to any disclaimer, the term of this patent is extended or adjusted under 35 U.S.C. 154(b) by 341 days.

(21) Appl. No.: 10/005,810

(22) Filed: Dec. 3, 2001

(65) Prior Publication Data

US 2002/0104177 A1 Aug. 8, 2002

Related U.S. Application Data

(60) Provisional application No. 60/250,659, filed on Dec. 1, 2000.

(51) Int. Cl.
*H02J 7/00* (2006.01)

(52) U.S. Cl. ..... 307/150; 307/149; 15/320

(58) Field of Classification Search ..... 307/149, 307/150; 15/28, 320
See application file for complete search history.

(56) References Cited

U.S. PATENT DOCUMENTS

| | | | | |
|---|---|---|---|---|
| 2,782,452 A | | 2/1957 | Kitto et al. | |
| 3,164,855 A | | 1/1965 | Hencken | |
| 3,688,139 A | | 8/1972 | Yaguchi | |
| 3,871,472 A | * | 3/1975 | Hosaka et al. | 280/735 |
| 4,045,836 A | | 9/1977 | Glenn | |
| 4,188,682 A | | 2/1980 | Burglin et al. | |
| 4,202,068 A | | 5/1980 | Lester et al. | |
| 4,399,578 A | | 8/1983 | Bordeaux | |
| 4,724,567 A | | 2/1988 | Rones | |
| 5,289,605 A | | 3/1994 | Armbruster | |
| 6,374,447 B1 | * | 4/2002 | Armbruster et al. | 15/28 |

* cited by examiner

*Primary Examiner*—Robert L. Deberadinis
(74) *Attorney, Agent, or Firm*—Baker & Daniels LLP

(57) ABSTRACT

A battery-powered washing unit is described which includes a motor drive unit driven by a DC battery pack with a yoke attached around the motor drive unit. An elongate and extendable handle is connected to the yoke for the user to grasp, and various brushes are connectable to the output shaft of the motor drive unit. Preferably the battery pack is sealed and self-contained and includes an integrated switch member at the top of the battery pack which consists of two powered positions, a low power and high power for various rotary speeds of the brush. Furthermore, the connection between the yoke and the motor drive unit consists of a locking mechanism having at least two locked positions, and a swivel position where the motor drive unit and the brush can swivel relative to the brush handle.

23 Claims, 19 Drawing Sheets

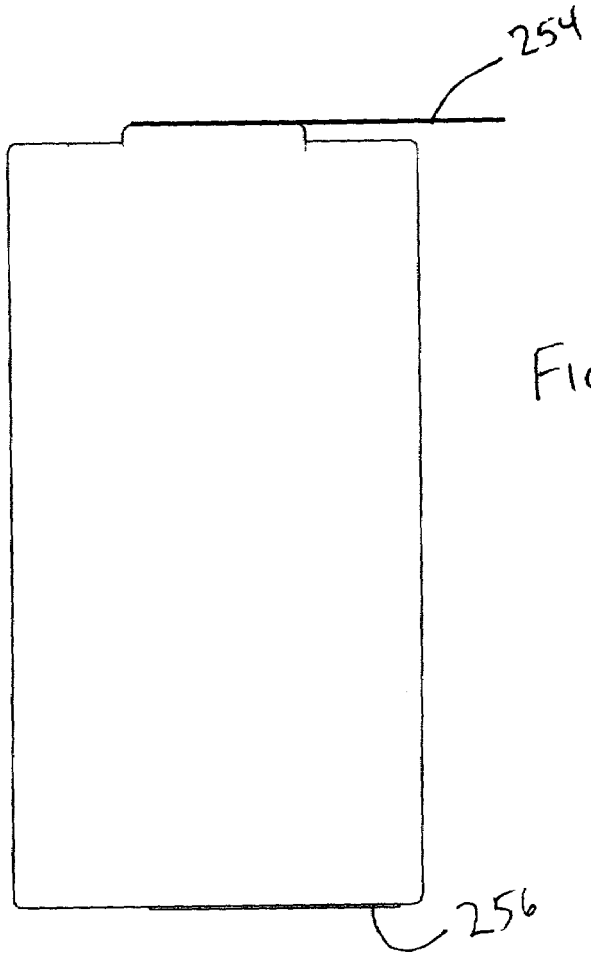
FIG 23
FIG 24
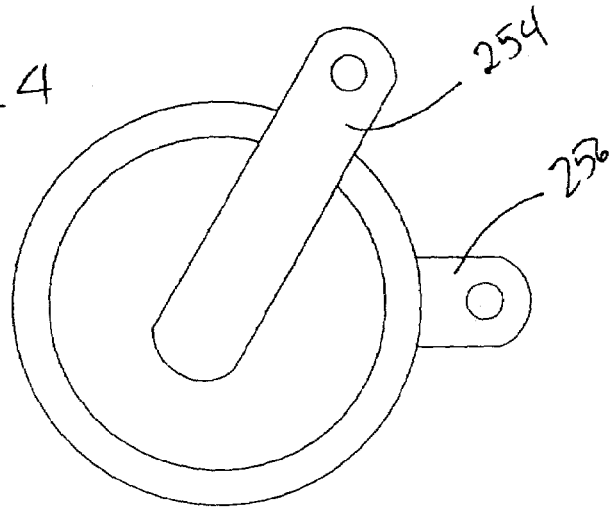

BATTERY-POWERED WASHER

BACKGROUND OF THE INVENTION

1. Field of the Invention

The invention relates to a hand-held washing unit which includes an elongate wand for holding by the user, with a brush on the end of the unit for assisting in the cleaning of objects, particularly useful for cleaning automobiles.

2. Discussion of the Prior Art

Many types of devices exist for cleaning objects such as automobiles, most of which include an elongate wand which is a conduit for receiving water therethrough. At the upper end of the wand is a hose bib for connection with a hose and at the opposite and lower end, a stationary brush which receives water therethrough. Some devices are designed such that a soap tablet can be positioned within the brush such that upon application of water, soap foam is produced through the brush for cleaning purposes. These designs have two inherent shortcomings. Firstly, due to the stationary brush, the user must exert great energy in the cleaning of an automobile to remove imbedded dirt, tar and the like. Secondly, as the water comes through the brush and forms the soap foam, the brush must be disconnected from the hose in order that the automobile can be rinsed with clean water.

Another type of design is shown in U.S. Pat. No. 5,289,605 to Armbruster, which anticipates a rotary brush driven by a DC battery. In this design, the brush anticipates that the motor wiring is brought through the elongate handle, and is connected to a battery pack which the user wears. This design is somewhat cumbersome and difficult to use and has an inherent design problem as it relates to the wiring coming through the elongate handle, as the elongate handle must extend and contract for the user as well as for the object to be cleaned.

These and other shortcomings of the prior existing designs have been accomplished by the below-described invention.

SUMMARY OF THE INVENTION

The objects of the invention have been accomplished by providing a hand held washing unit comprising a motor drive unit comprising a housing having an upper battery receiving cavity and a lower motor receiving cavity, a motor received in the lower cavity, electrical contacts positioned within the upper cavity being electrically connected to the motor, a linkage drivingly connected to the motor, and an output drive member connected to the linkage; an elongate handle connected to the motor drive unit for grasping while in use; a battery pack receivable in the upper cavity, the battery pack having a housing for receipt of at least one battery, the battery being electrically connected to battery contacts external of the housing, the battery being in alignment with the motor contacts; and a switch interconnected between the battery and motor, for switching power between the battery and motor; whereby, upon installation of the battery pack into the upper cavity, the battery contacts electrically engage the motor contacts, electrically interconnecting the battery to the motor.

Preferably, the motor drive axis and the output drive member are aligned along a common axis. The upper cavity is in alignment with the common axis, such that the battery is installed along the common axis. The battery pack includes a plurality of serially connected batteries connected at opposite poles to the battery contacts. The battery pack is comprised of a bipartite housing comprising an upper housing and lower housing, the bipartite housing including battery positioning walls therein, and three batteries positioned therein. The switch is preferably intermediate the serial connection, and is installed in the battery pack. The battery pack is comprised of a housing member having an upper and lower surface, the battery contacts being positioned on the lower surface, and being receivable within the upper cavity, the switch being positioned within the switch housing member, the battery pack further comprising an actuator for the switch, the actuator extending through the upper surface of the housing member. The switch includes a full power position and a partial power position, the partial power position having silicon rectifier diodes in series therewith, for controlling the voltage drop.

In another aspect of he invention, a hand held washing unit comprises a motor drive unit comprising, a housing having a lower drive train receiving cavity, a drive train positioned within the receiving cavity, the drive train comprising a motor positioned in and held by a gear casing, the gear casing having gear teeth on an inner periphery thereof, and a planetary gear assembly positioned within the gear casing and driven by the motor, the planetary gear assembly having an output drive shaft, a brush for connection with the output drive shaft, an elongate handle connected to the motor drive unit for grasping while in use, and a battery assembly for connection with the motor for driving the motor.

Preferably, the planetary assembly is comprised of a double planetary gear set. The motor drive unit is further comprised of a housing having an upper battery receiving cavity and a lower receiving cavity, the motor and planetary gear assembly positioned in the lower cavity, and electrical contacts positioned within the upper cavity being electrically connected to the motor. The battery assembly is comprised of a battery pack receivable in the upper cavity, the battery pack having a housing for receipt of at least one battery, the battery being electrically connected to battery contacts external of the housing, the battery being in alignment with the motor contacts. The battery pack includes a plurality of serially connected batteries connected at opposite poles to the battery contacts. The battery pack is comprised of a bipartite housing comprising an upper housing and lower housing, the bipartite housing including battery positioning walls therein, and three batteries positioned therein. The switch is intermediate the serial connection. The switch is installed in the battery pack. The battery pack is comprised of a housing member having an upper and lower surface, the battery contacts being positioned on the lower surface, and being receivable within the upper cavity, the switch being positioned within the switch housing member, the battery pack further comprising an actuator for the switch, the actuator extending through the upper surface of the housing member. The switch includes a full power position and a partial power position, the partial power position having silicon rectifier diodes in series therewith, for controlling the voltage drop.

In yet another aspect of the invention, a hand held washing unit comprising, a motor drive unit comprising a housing having a lower motor receiving cavity, a motor received in the lower cavity, a linkage drivingly connected to the motor, an output drive member connected to the linkage; a battery connected to the motor, a yoke attached to the motor drive unit and an elongate handle connected to the yoke for grasping while in use, the yoke having a locking mechanism cooperable between the yoke and drive unit, the locking mechanism having a plurality of locked positions, locking the motor drive unit in a plurality of positions.

Preferably, the yoke has yoke arms flanking the motor drive unit, and the locking mechanism is comprised of a locking ring attached to the motor drive unit, inside one of the yoke arms, and a selector knob cooperable with the locking ring and extending through the yoke arm, the selector knob being rotatable between select positions whereby the knob can be locked to the locking ring and to the yoke arm. The cooperation between the selector knob, the locking ring and the yoke arm provides two locked positions and a floating position.

In yet another aspect of the invention, a battery powered apparatus and charging assembly, comprises a drive mechanism having a housing, a motor and a linkage to a drive member, the housing having a battery receiving cavity. A battery pack is receivable in the battery-receiving cavity, and is latchably attached within the cavity. A storage member for positioning on a wall is provided, having a hanging bracket for storing the unit, the storage member further comprising a charging unit which receives the battery pack in a charging configuration. In this manner the battery pack can be removed from the apparatus, the apparatus stored on the storage member, and the battery removed and placed in the charging unit.

Preferably, the charging unit is removable from the storage member.

BRIEF DESCRIPTION OF THE DRAWINGS

FIG. 13A is a cross-sectional view through lines 13A—13A of FIG. 13;

FIG. 23 is a side plan view of one of the batteries for the battery pack;

FIG. 24 is an end plan view of the battery of FIG. 23;

DETAILED DESCRIPTION OF THE PREFERRED EMBODIMENT

Figure 1:
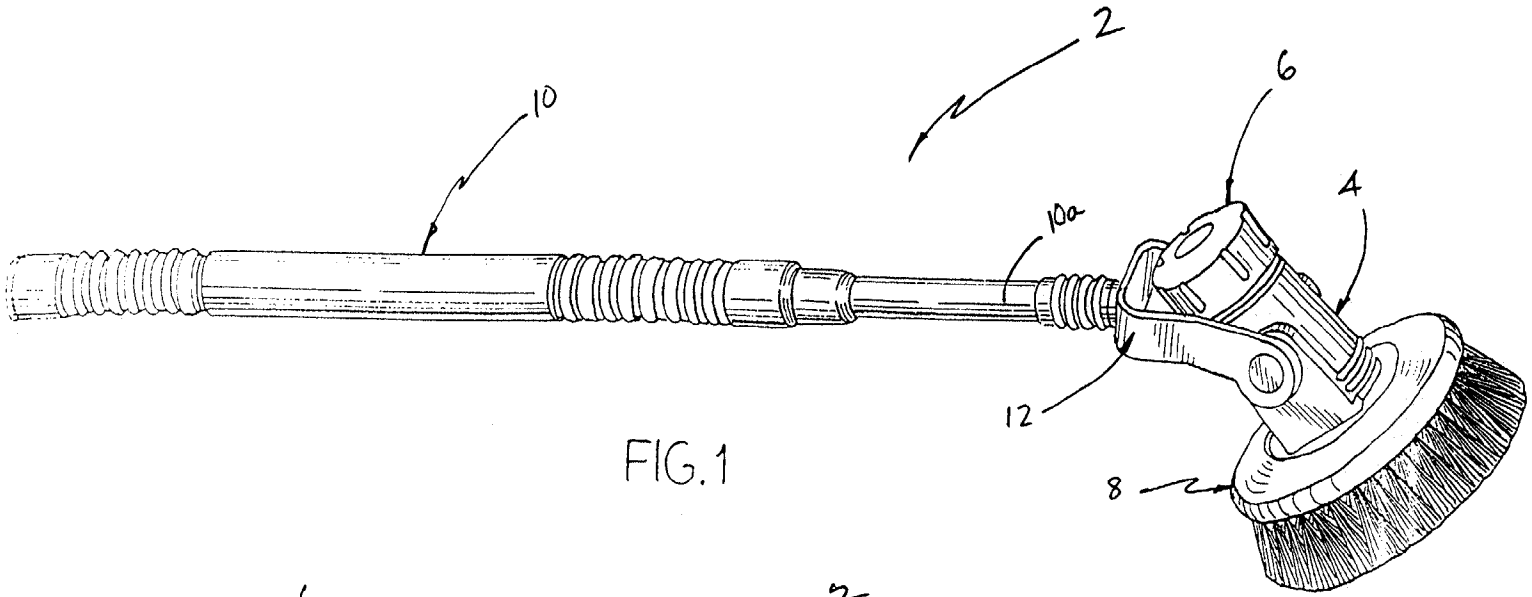
FIG. 1 is a perspective view of the battery-powered washer with the brush oriented at an angle relative to the handle.
Figure 2:
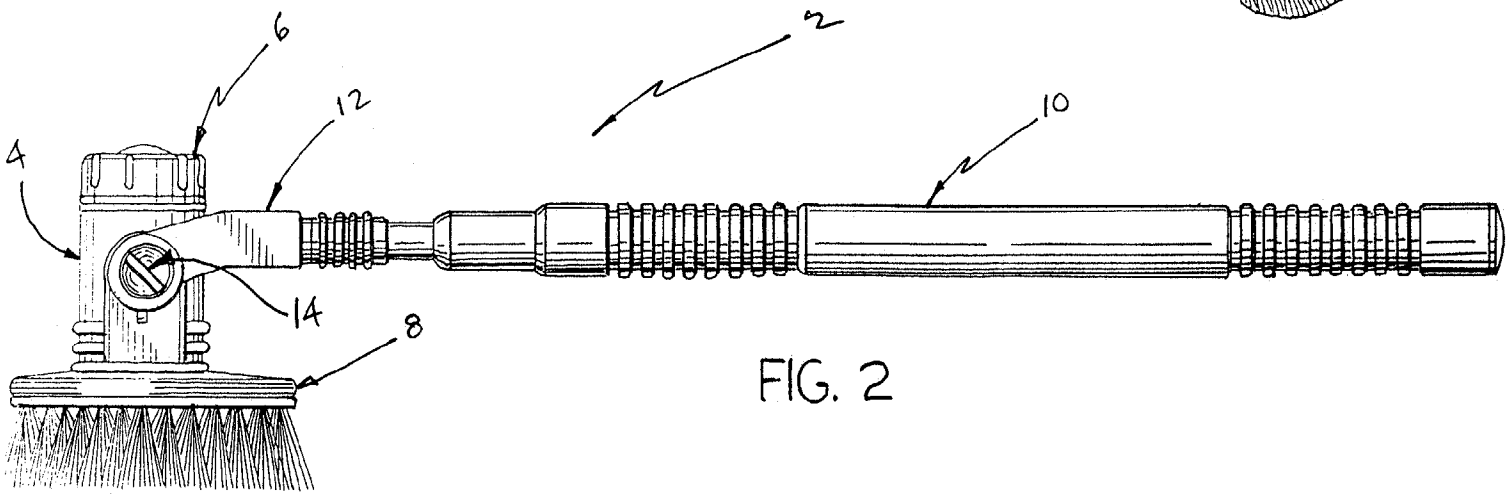
FIG. 2 is a side view of the hand-held scrubber from the opposite side as that shown in FIG. 1 showing the brush and handle in approximately parallel orientation.
Figure 3:
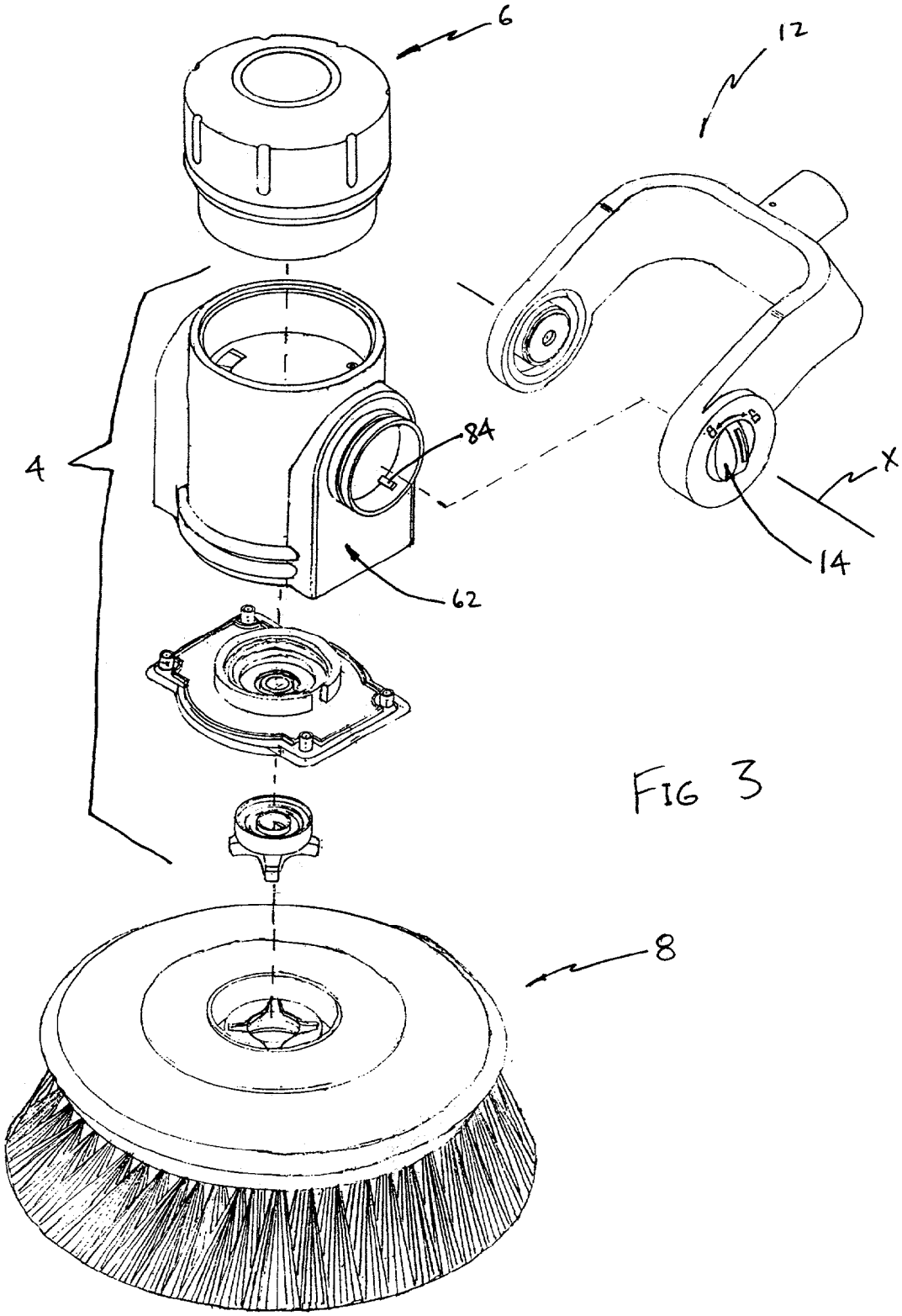
FIG. 3 is an exploded view of the major components of the subject invention.

As shown in FIGS. 1 and 2, the battery-powered washer of the present invention is shown generally at 2, and includes a motor drive unit 4, a battery pack 6, an attachment such as a brush 8, an elongate handle 10 attached to the motor drive unit 4 by way of a yoke 12, and a lock selector knob 14. As shown in FIG. 3, the various components are shown exploded away from the motor drive unit 4, the brush 8 being shown unsnapped from the motor drive unit 4, the battery pack 6 being shown removed from the upper portion of the motor drive unit 4, and the yoke 12 being shown removed from the motor drive unit 4.

Figure 4:
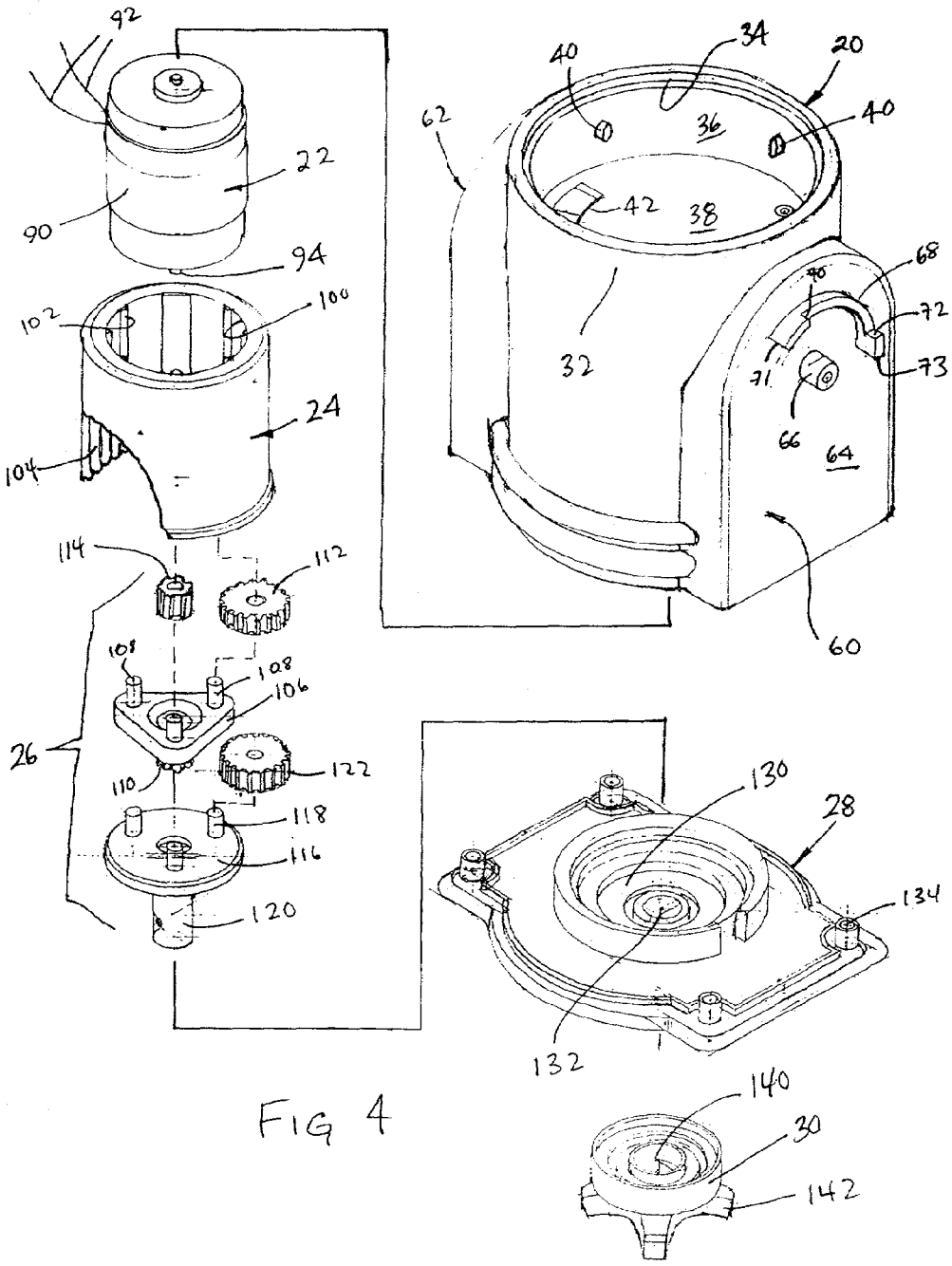
FIG. 4 is an exploded view of the motor drive unit of the subject invention.
Figure 9:
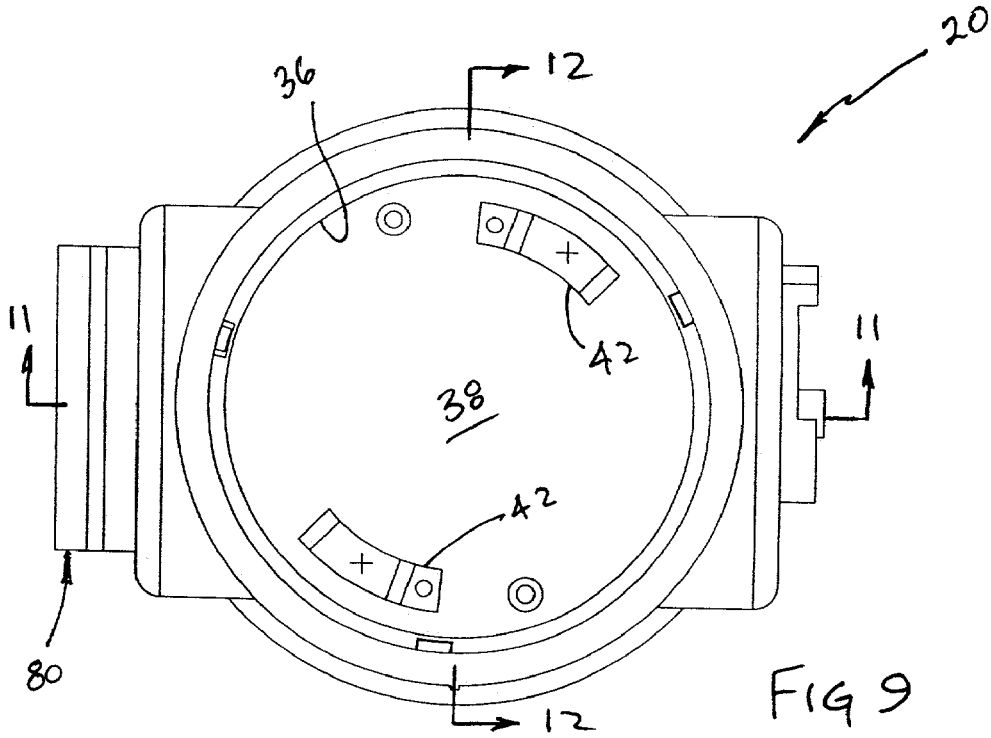
FIG. 9 is a top plan view of the motor drive unit housing shown in FIG. 5.

With respect to FIGS. 4, 5, and 9 through 12, the motor drive unit 4 will be described in greater detail. With respect first to FIG. 4, the entire motor drive unit 4 is shown in an exploded manner with the motor drive unit 4 generally including a motor housing 20, an electric DC motor 22, a gear casing 24, a double planetary gear set 26, a lower cover 28, and a drive lug 30. As shown in FIG. 4, the motor housing 20 generally comprises a cylindrical housing portion 32 having an upper cylindrical portion 34 comprised of an inner surface 36 and an intermediate wall at 38. The inner surface 36 includes a plurality of lugs at 40 for locking the battery in place as will be described in further detail. As shown in FIG. 4 and FIG. 9, housing 20 includes an electrical contact pad at 42 which has a wire contact portion extending through the surface 38 for contact with the motor wiring as will be described herein.

Figure 10:
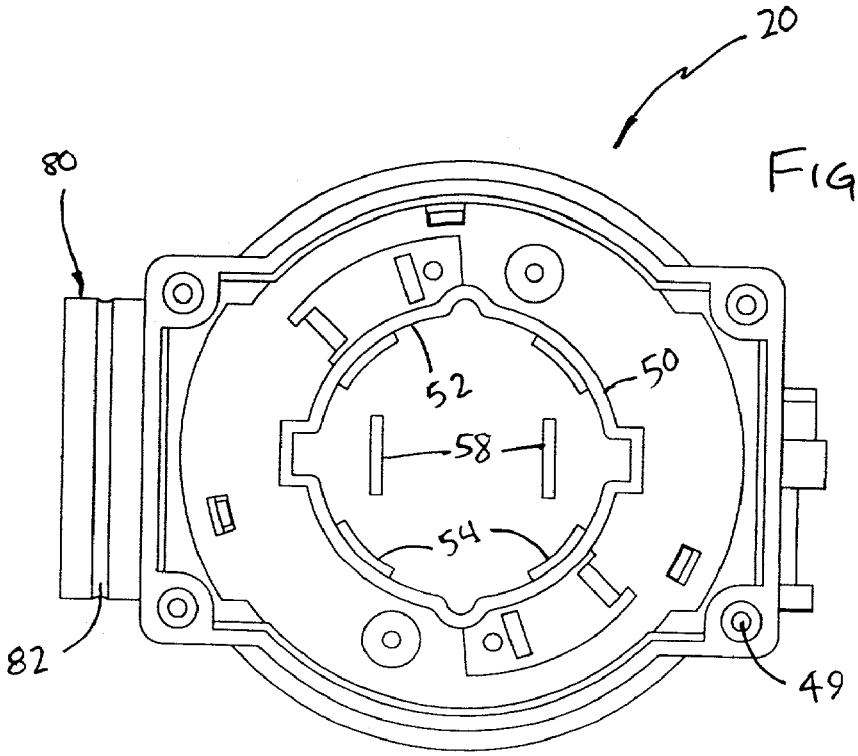
FIG. 10 is a bottom plan view of the housing shown in FIG. 9.
Figure 12:
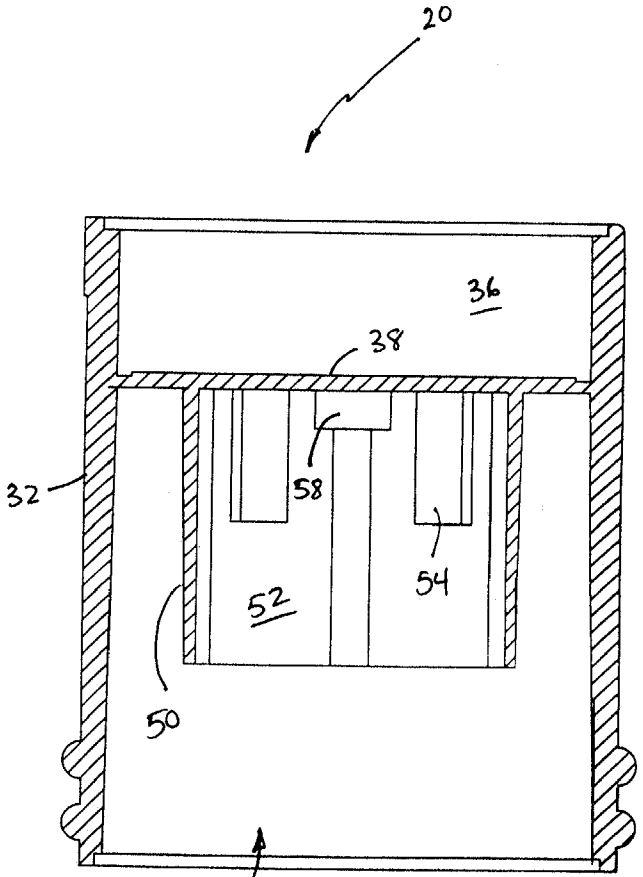
FIG. 12 is a cross-sectional view through lines 12—12 of FIG. 9.
Figure 11:
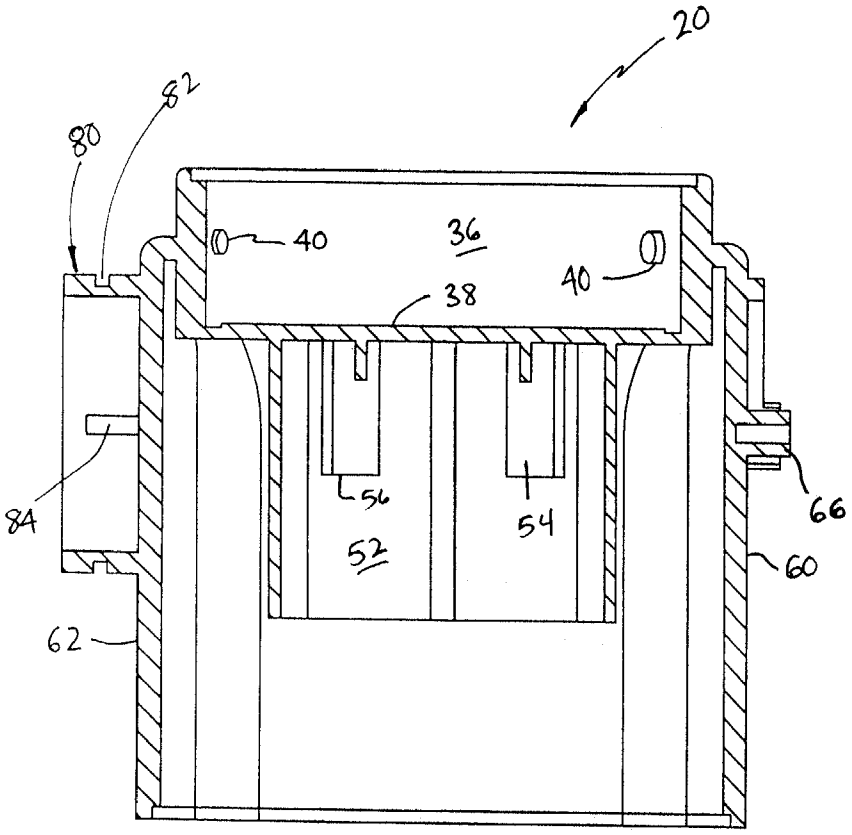
FIG. 11 is a cross-sectional view through lines 11—11 of FIG. 9.

With respect now to FIGS. 9 through 12, the housing 20 includes a lower opening at 48 to access an extension wall 50 projecting downwardly from upper wall 38. Extension wall 50 has an internal peripheral surface 52 having arcuate stop lugs 54 positioned thereon having stop surfaces at 56. Stop lugs 58 extend downwardly from the wall 38 and are positioned intermediate the stop lugs 54. Finally, as shown in FIG. 4, housing 20 includes end flat sections 60 and 62 where section 60 includes a flat end surface 64 having a mounting post 66 extending therefrom and an arcuate rotational stop 68 having end stops at 70, 72 as described herein. As shown in FIGS. 3 and 11, end wall 62 includes a cylindrical mounting section 80 having a slot at 82, and diametrically opposed locking ribs 84 (only one of which can be viewed from FIG. 11).

With respect now to FIG. 4, the drive train of the motor drive unit 4 includes the motor 22, gear casing 24, and double planetary assembly 26. Motor 22 is a DC motor having an outer body portion 90, leads 92, and an output shaft 94. The gear casing 24 includes an inner opening at 100 having a plurality of protrusions 102 for retaining the electric motor 22 as described herein. The lower half of planetary housing 24 includes on the inner diameter thereof, planetary gear teeth 104 for cooperation with the planetary gear train 26.

The planetary gear train 26 is comprised of a triangular drive member 106 having upstanding drive posts 108 and a drive pinion 110 extending from the opposite side. Planetary gears 112 are positioned on each of the posts 108 (only one such planetary gear at 112 shown) and pinion gear or sun gear 114 is driven by the output shaft 94 of the motor, with the pinion 114 being drivingly positioned in the center opening adjacent to the three planetary gears 112 and in driving connection therewith. Planetary gear assembly 26 further includes a drive member 116 having three upstanding posts 118 and an output drive shaft 120. Three planetary gears 122 are positioned over the posts and then receive between them output pinion 110 from the drive member 106.

As shown in FIG. 4, lower cover 28 includes a receiving area at 130 and an opening 132 profiled to receive the drive shaft 120. Openings 134 align with threaded openings 49 in the housing 20 (FIG. 10) for receipt of a fastener to retain the assembly together. Finally, drive member 30 includes an opening 140 profiled to cooperate with drive member 120, and further includes drive teeth 142. It should be appreciated to those skilled in the art that the drive member 30 is held to the drive shaft 120 by way of a spring clip or cotter pin, as is well known in the art.

Figure 13:
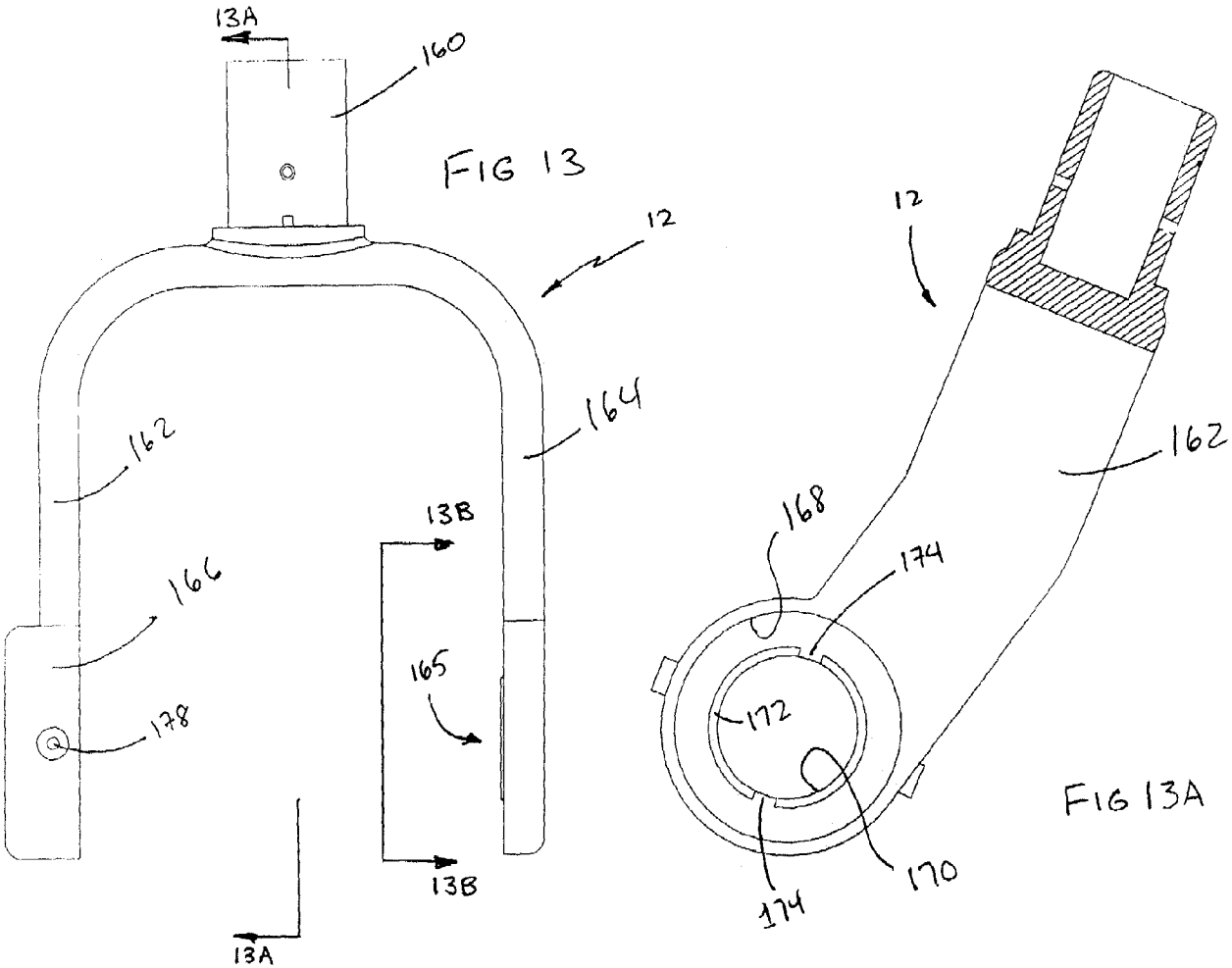
FIG. 13 is a front plan view of the yoke which is used on the handle of the washer shown in FIG. 1.
Figure 14:
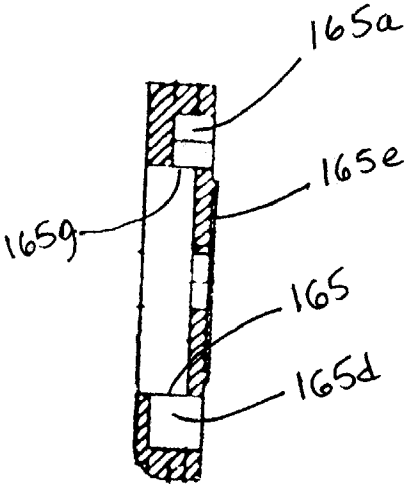
FIG. 14 is a cross-sectional view through lines 14—14 of FIG. 13B.

With reference now to FIGS. 5 and 13 through 19, yoke 12 and the locking assembly 14 will be described in greater detail. The locking assembly 14 is comprised of a selector knob 150, a locking ring 152, and a compression spring 154. The knob assembly 14 cooperates with the locking lug 84 on housing 20, as well as with the yoke 12. With reference to FIGS. 13 and 14, the yoke is shown as including a socket portion 160 having yoke arms 162 and 164 extending therefrom. Yoke arm 164 includes a receiving end 165, while yoke arm 162 includes a cupped-shape portion 166 at a lower end thereof. The cupped-shape portion 166 has a recessed portion at 168, the recessed portion 168 having an inside diameter slightly greater than the outside diameter of member 80 on the housing 20. The cupped-shape portion 166 further includes an opening at 170 with a recessed section at 172 surrounding the perimeter of the opening 170, thereby forming lock lugs 174. Finally, an opening at 178 carries a set screw as will be described herein.

Figure 13B:
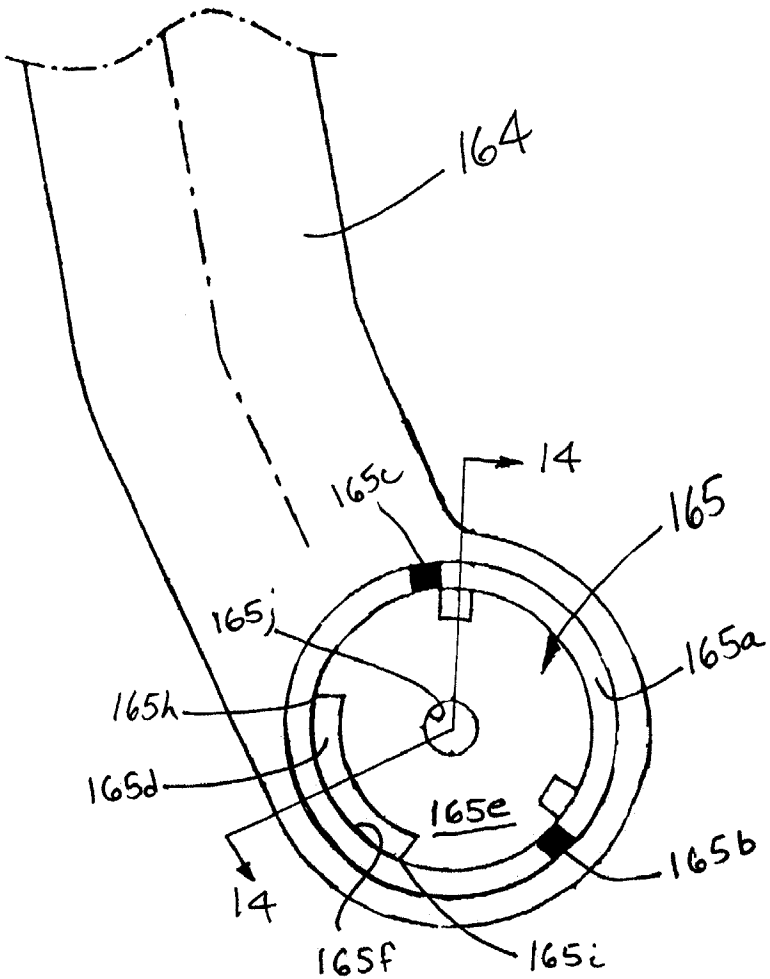
FIG. 13B is a cross-sectional view through lines 13B—13B of FIG. 13.

With respect now to FIGS. 13B and 14, the receiving end 165 is shown in greater detail. It should be understood in general that receiving end 165 is profiled to be received over post 66 and rotational stop 68 (FIG. 4) and generally includes an annular channel at 165*a* having stops 165*b* and 165*c*. A cut-out section is formed in the molding of the yoke at 165*d* to extend downwardly and through wall section 165*e* forming an arcuate-shaped opening at 165*f* extending through to circular opening 165*g*. Thus, an arcuate opening 165*f* exists connecting annular channel 165*a* and annular opening 165*g* the length of the arcuate slot 165*d*. This arcuate slot 165*d* also forms an edge at 165*h* and at 165*i* as will be described herein. Finally, an opening 165*j* extending through wall 165*e* is centrally located relative to the receiving end 165.

Figure 15:
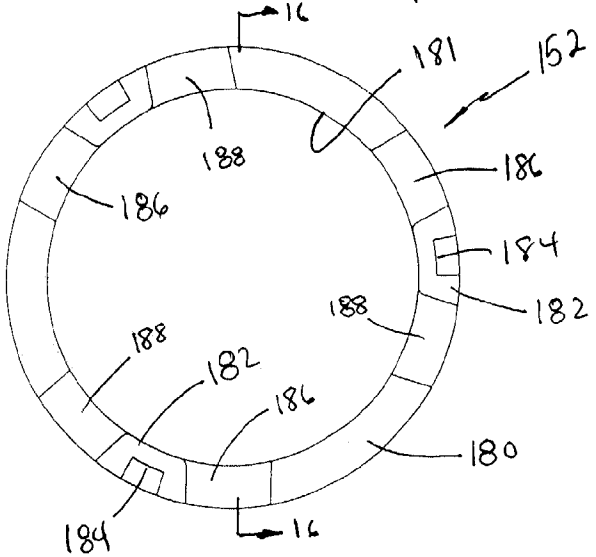
FIG. 15 is a top plan view of the locking ring shown in FIG. 5.
Figure 17:
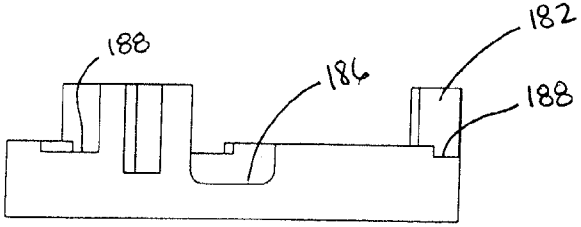
FIG. 17 is a side plan view of the locking ring of FIG. 15.
Figure 16:
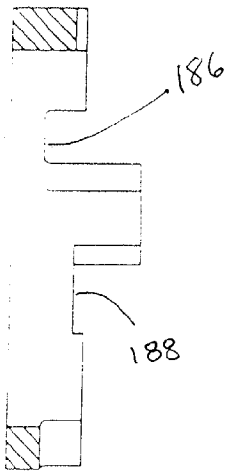
FIG. 16 is a cross-sectional view through lines 16—16 of FIG. 15.
Figure 20:
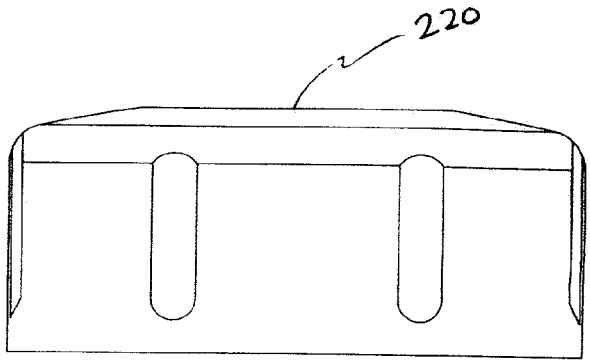
FIG. 20 shows a side plan view of the battery housing.
Figure 22:
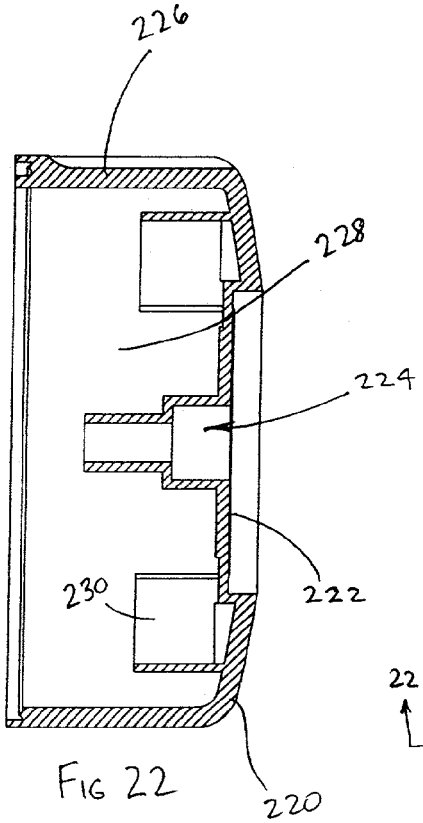
FIG. 22 is a cross-sectional view through lines 22—22 of FIG. 21.
Figure 21:
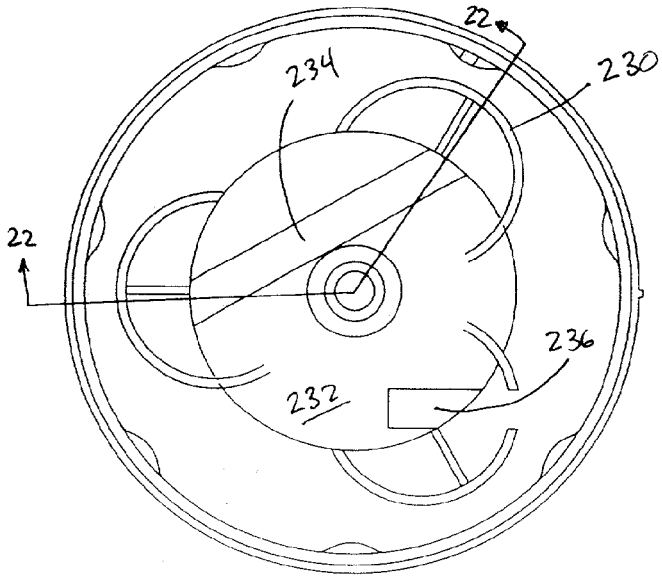
FIG. 21 shows a bottom plan view of the battery housing of FIG. 20.
Figure 25:
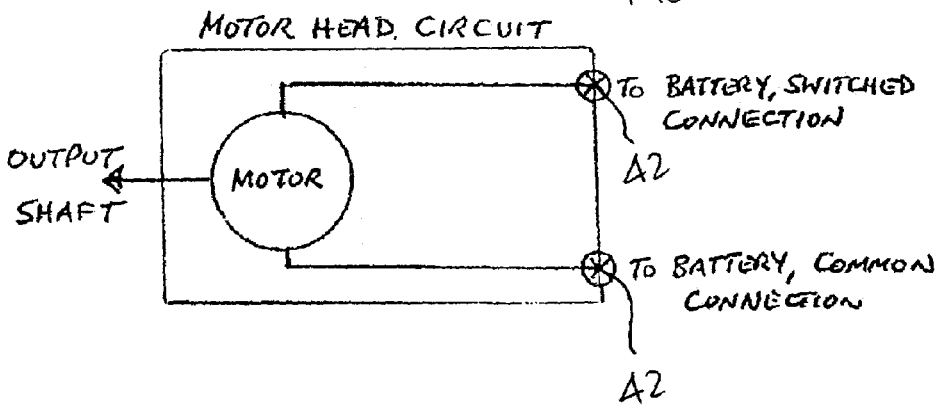
FIG. 25 is a circuit schematic of the motor head.

With respect now to FIGS. 15 through 17, the locking ring 152 will be described in detail. The locking ring 152 includes an annular ring section 180 having projecting arms 182 which project outwardly from the annular ring section 180 and include on an outer surface thereof slots 184, which are profiled to be slidably receivable over the ribs 84 on housing 20. The annular ring 180 is further defined by cut-outs 186 positioned on one side of the arms 182, which extend deeply into the annular ring 180 as shown best in FIGS. 16 and 17. On the opposite side of the arms 182 are cut-outs 188 which are shallow as compared to cut-outs 186 as best shown in FIGS. 16 and 17.

Figure 18:
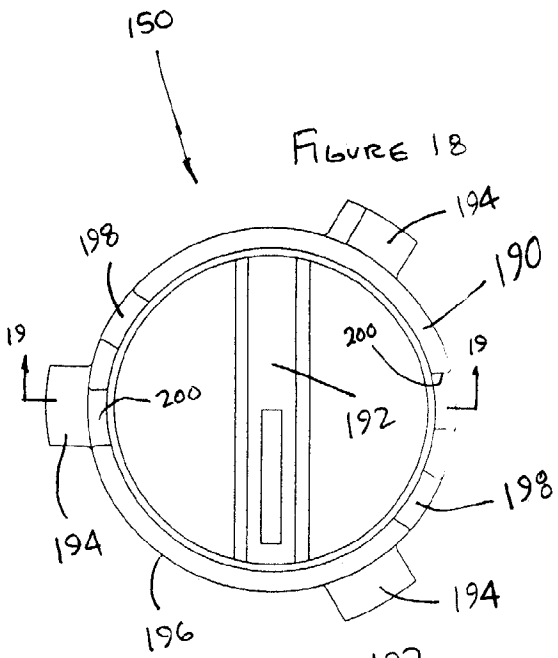
FIG. 18 is a top plan view of the locking selector knob shown in FIG. 5.
Figure 19:
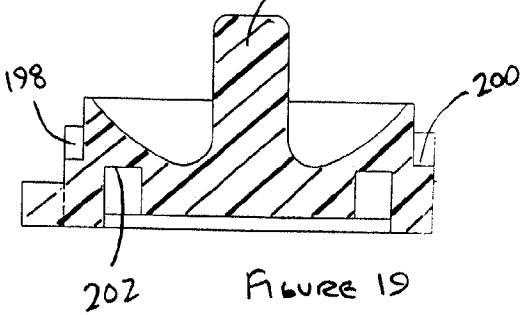
FIG. 19 is a cross-sectional view through lines 19—19 of FIG. 18.

With respect now to FIGS. 18 and 19, the selector knob 150 is shown as generally including an annular body portion 190 having a knob handle 192 for grasping and turning the knob as is generally known in the art. As shown in FIGS. 18 and 19, the selector 150 includes three locking feet 194 extending radially outwardly therefrom and have a width which is somewhat less than the width of either of the cut-outs 186 or 188. Furthermore, the outer diameter 196 of the ring 190 is profiled to be receivable within the diameter 181 of the annular ring 180. The annular ring 190 includes two pair of slots 198, 200 diametrically opposed from each other as described further herein. It should be recognized, however, that the width of the slots 198, 200 is profiled to be receivable over the lugs 174 shown in FIG. 13A.

With reference now to FIGS. 6 and 20–22, the battery assembly will be described in greater detail. The battery assembly 6 is comprised of an upper housing portion 220 having a recess at 222 with a centrally located aperture at 224. The housing 220 has an outer annular wall portion 226 forming an internal cavity at 228. Receiving nests are formed by arcuate walls at 230 for receiving and locating batteries as described further herein. The housing 220 further includes an internal upper surface at 232 having locating slots at 234 and 236. The battery assembly 6 also includes a plunger assembly including a plunger rod 240 receivable through a compression spring 242 and a membrane seal 244 for positioning above the plunger 240, and a lock ring 246 for containing the assembly together, as more fully disclosed herein.

Figure 6:
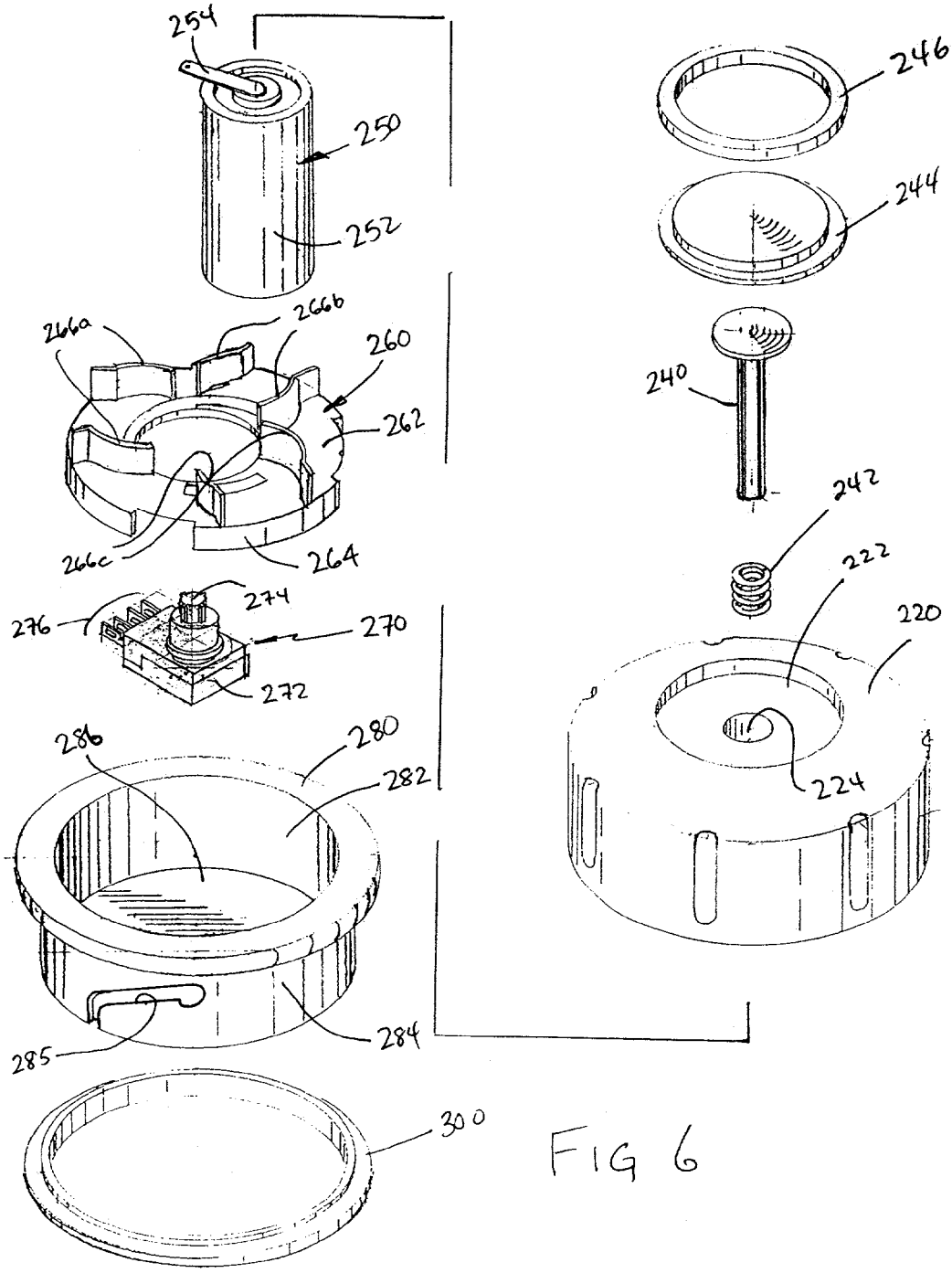
FIG. 6 shows an exploded view of the self-contained battery pack.

With respect now to FIGS. 6, 23 and 24, the individual battery member is shown at 250 including a rechargeable cell body at 252 and includes electrodes at 254 and 256 to provide the opposite polarity connections as is well known in the art. In the preferred embodiment of the invention, the batteries are comprised of nickel cadmium rechargeable batteries. With respect still to FIG. 6, a lower platen 260 is shown having a plate portion 262 having stand-off legs at 264. The platen 260 includes arcuately shaped walls arranged in pairs such as pairs 266*a*, 266*b*, and 266*c*. It should be appreciated that these pairs of walls are arcuately configured to receive and position the battery member 250 in a predetermined position relative to the other batteries and to the battery assembly as further described herein.

Figures 7, 8:
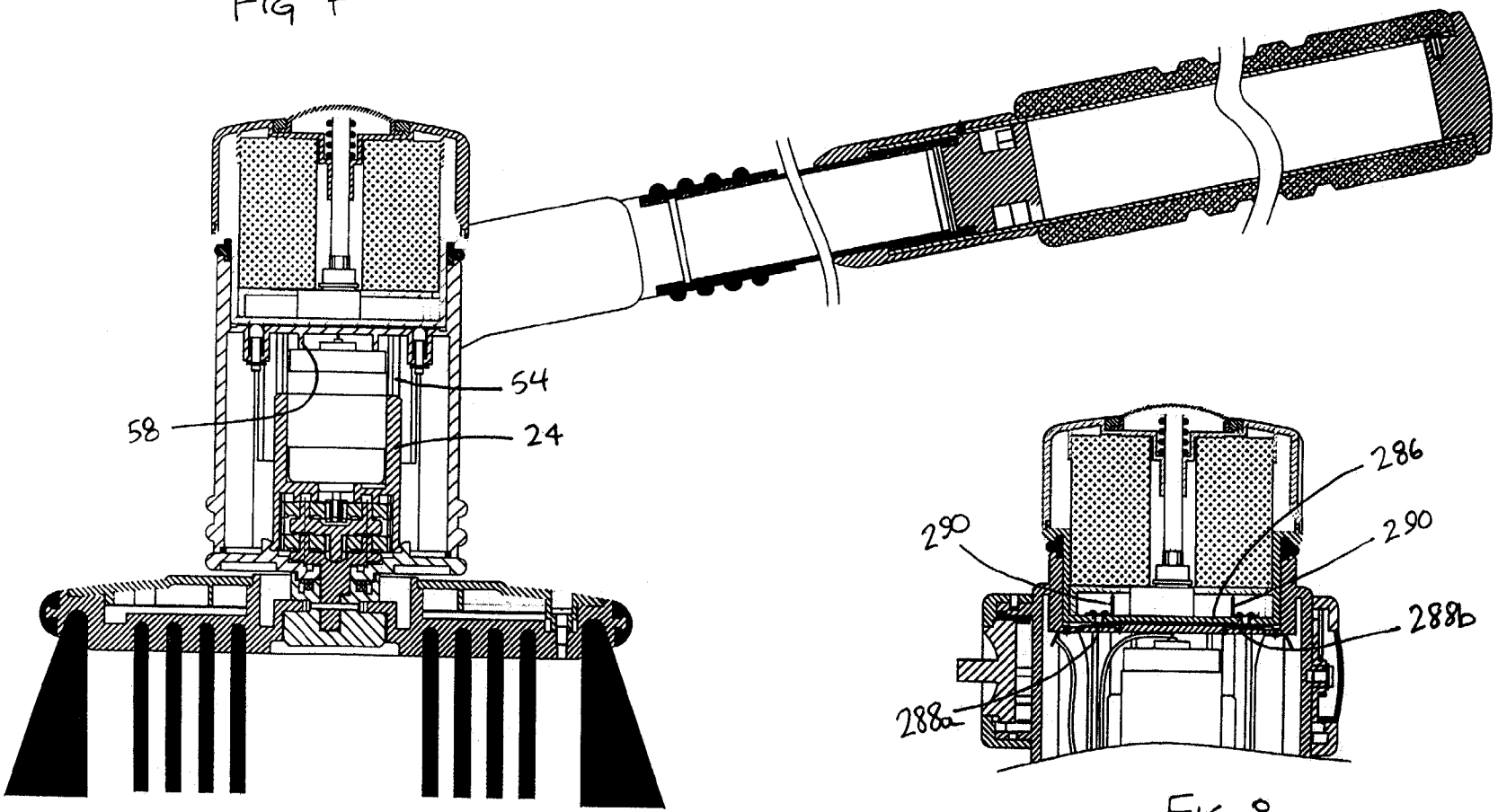
FIG. 7 shows a length-wise cross-sectional view of the entire assembly.
FIG. 8 shows an exploded view of the battery portion of FIG. 7.

With reference still to FIG. 6, a switch member is shown at 270 including a switch body 272 and a switch contact at 274. The switch 270 further includes a plurality of electrical terminals 276 for the connection of individual wire conductors thereto for switching of electric power from the battery to the motor. In the preferred embodiment of the invention, the switch is operated by the pushing of the contact switch 274 and can operate between three positions, off, low power, and high power. With respect to FIGS. 6 and 8, the battery 6 further includes a lower housing portion 280 which is cooperable with the upper housing portion 220 to form a sealed enclosure. Such cooperation could be formed by ultrasonic welding or by adhesive fixing or other known means in the art. The lower housing portion 280 includes an internal cavity at 282 formed by an annular outer wall 284 and a floor at 286. The floor at 286 includes openings therethrough for contact tabs 288 which cooperate with the contacts 42 on the motor housing and further include wire contact portions at 290 for connection of the power from the batteries and switch as described herein. Finally, the battery portion includes an outer annular seal member 300 which is slidably receivable over the outer wall portion 284 to form a sealed connection with the motor drive unit 4 as further described herein. With the battered powered washer as described above, the assembly of the unit will now be described with respect to the various drawing figures.

With respect to FIG. 4, the assembly of the motor drive unit 4 will be described in detail. The pinion gear 114 is first assembled to the output shaft 94 of the motor 22, and the assembled motor 22 is then inserted into the gear casing 24. As mentioned above, the motor 22 is held within the gear casing 24 by an interference fit between the outer surface 90 of the housing 22 and the projections 102 in the gear casing 24. The double planetary gear set is then assembled by positioning the planetary gears 122 over the individual posts 118 and then by placing the pinion gear 110 intermediate the three assembled planetary gears 122. The planetary gears 112 are then assembled to their respective posts 108, and the assembly of the double planetary gear set 26 is then positioned inside of the gear casing 24 such that the first three planetary gears 112 are meshing with the gears 104, and then further inserted such that the planetary gears 122 mesh with the gears 104. Continued insertion of the double planetary gear set 26 will cause the pinion gear 114 to be drivingly positioned between the three planetary gears 112. When the double planetary gear set 26 is fully assembled as described above, the assembly of the motor 22, the gear casing 24, and the double planetary gear set 26 can be positioned within the housing 20, to a position where the motor 22 abuts the stand-offs 58 and the end of the gear casing 24 abuts the arcuate sections 54 (see FIG. 7). At this position, lower cover 28 can be assembled to the housing 20 by allowing drive shaft 120 to project through opening 132, and by positioning fasteners through apertures 134 into housing openings 49 (FIG. 10). The drive member 30 can then be assembled to the drive shaft 120 by way of a cotter pin or spring pin.

Figure 5:
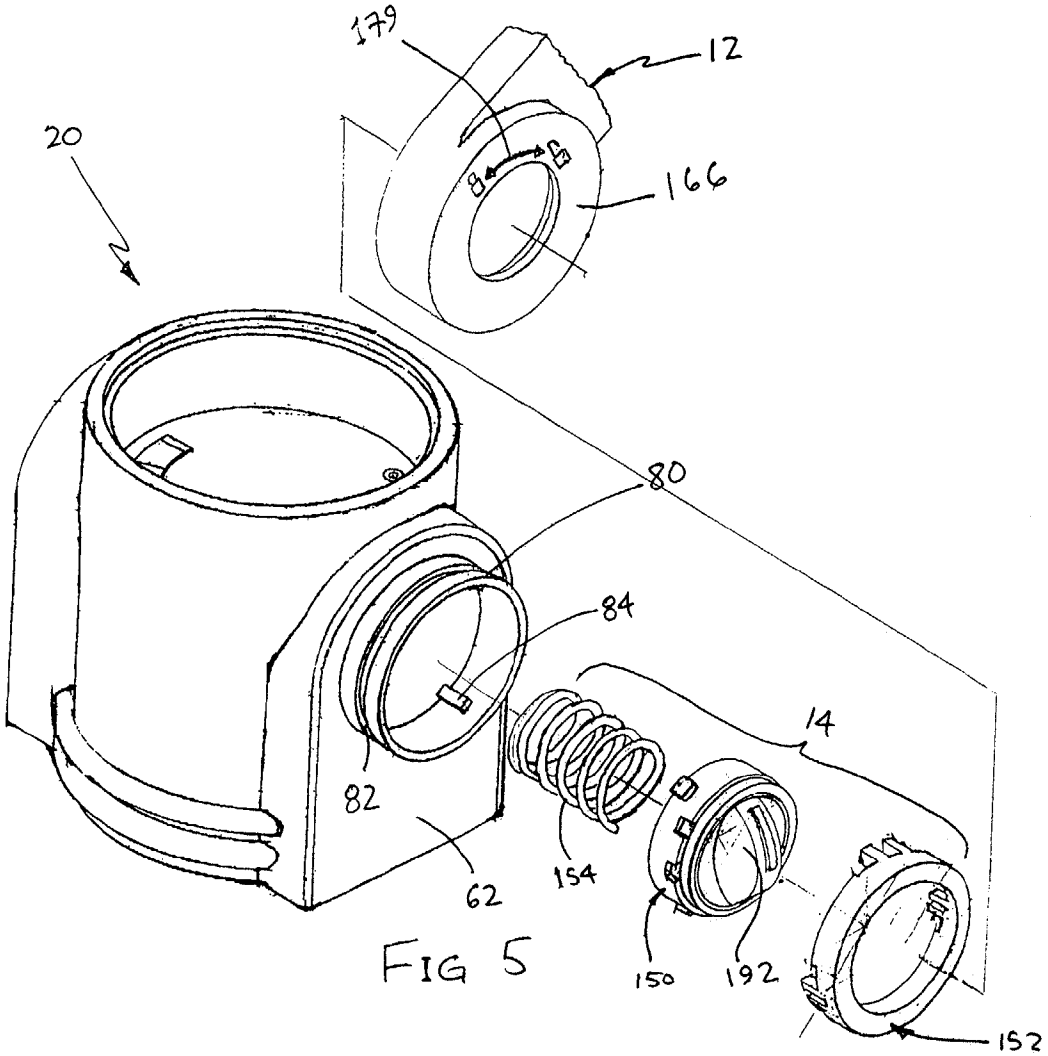
FIG. 5 shows an exploded view of the locking mechanism between the motor drive unit and handle.

With respect now to FIGS. 5 and 13 through 19, the assembly of the locking mechanism 14 will now be described. The compression spring 154 is first inserted in the annular recess 202 and the locking ring 152 is then positioned over the selector knob 150 such that the feet 194 position themselves within the cut-outs 186. This assembly can then be positioned within the cylindrical member 80 such that the slots 184 are slidably received over ribs 84. The yoke 12 can then be assembled over the cylindrical portion 80 to a position where raised sections 174 are received in one of the slots 198, 200 on the knob 150. As shown in FIG. 5, the yoke 12 includes indicia 179 showing a locked and unlocked position, which corresponds to locked and unlocked positions between the yoke and the housing 20. When the selector knob 150 is aligned such that knob portion 192 is aligned with the locked indicia, the feet 194 of knob 150 are received in cut-outs 186 of the locking ring 152. In this position, knob 150 is spring loaded to its fullest extent, outwardly of the retaining ring 152 such that one of the slots 198 or 200 engages with the projections 174 of the yoke member. To allow the motor drive unit 4 to swivel, the selector knob 150 is rotated to a position clock-wise where the locking feet 194 now reside within cut-outs 188. In this position, the selector knob 150 is spring loaded inwardly further towards surface 62 to a position where slots 198, 200 do not engage lugs 174, and thus yoke 12 is free to rotate relative to motor drive unit 4.

Figure 26:
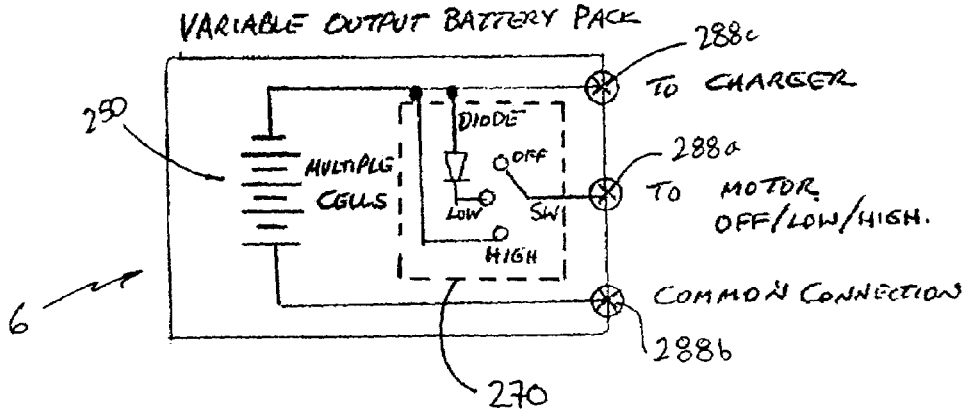
FIG. 26 is a circuit schematic for the battery pack.

With reference to FIGS. 6 and 26, the assembly of the battery pack will be described. The switch 270 is mounted to the inner surface 286 of the lower housing portion 280 such that the switch member 274 is positioned at the center of opening 280. Platform 260 can then be positioned within the opening 282 such that switch member 274 extends upwardly through the center opening of plate 260. The individual batteries 280 can then be positioned between their respective arcuate walls 266*a*, 266*b*, and 266*c* and then wired to the switch. It should be appreciated that the individual batteries are connected to each other in series and then run through the switch for the switched connection. It should also be appreciated from FIG. 26 that the battery member 6, will include three contact members, two of which will be for connection to the contacts 42 of the housing 20 and one for charging as to be described herein. In the preferred embodiment of the invention, the voltage variation is obtained by using a series of connected silicon rectifier diodes connected to the three-position switch that functions as off/low/high. The advantage of using the silicon rectifier diodes is that an almost constant voltage drop is obtained across the device (typically 0.7 volts), as compared to using a resistor which would have a varying voltage drop depending upon the motor load current.

With the batteries wired together and through the switch contact elements 276 and to the battery contacts 288*a* and 288*b*, the upper housing portion 220 can be assembled to the lower housing portion 280. In this respect, plunger 240 is positioned through the compression spring 242 and then into opening 224. The membrane 244 is then positioned over plunger 240 and locking ring 246 positioned in place. Once again, locking ring 246 could either be adhesively fixed within the recess 222 or could be ultrasonically bonded therein. The upper housing 220 is then fixed to the lower housing 280, again either adhesively or through ultrasonic welding. It should be appreciated then that the battery assembly 6 is a self-contained and sealed connection, as well as provides an integrated switch connection from the exterior of the battery pack by depressing membrane 244 activating plunger 240 which contacts switch contact 274. Thus, the battery pack can be alternatively advanced through the modes power off, low power, and high power from the exterior of the battery.

As described above, the battery is ready for installation within the motor drive unit 4 and the unit can be used. As shown in FIG. 6, it should be appreciated that the battery lower housing 280 includes bayonet-style slots 285 for connection with the lugs 40 in FIG. 11. It should be appreciated that when the battery 6 is positioned as described above, contacts 288*a* and 288*b* of the battery contact corresponding contacts 42*a* and 42*b* of the motor drive unit. As shown in FIG. 26, a separate and unswitched lead wire extends between a third contact of the battery 288*c* directly to the batteries for charging purposes.

Figure 27:
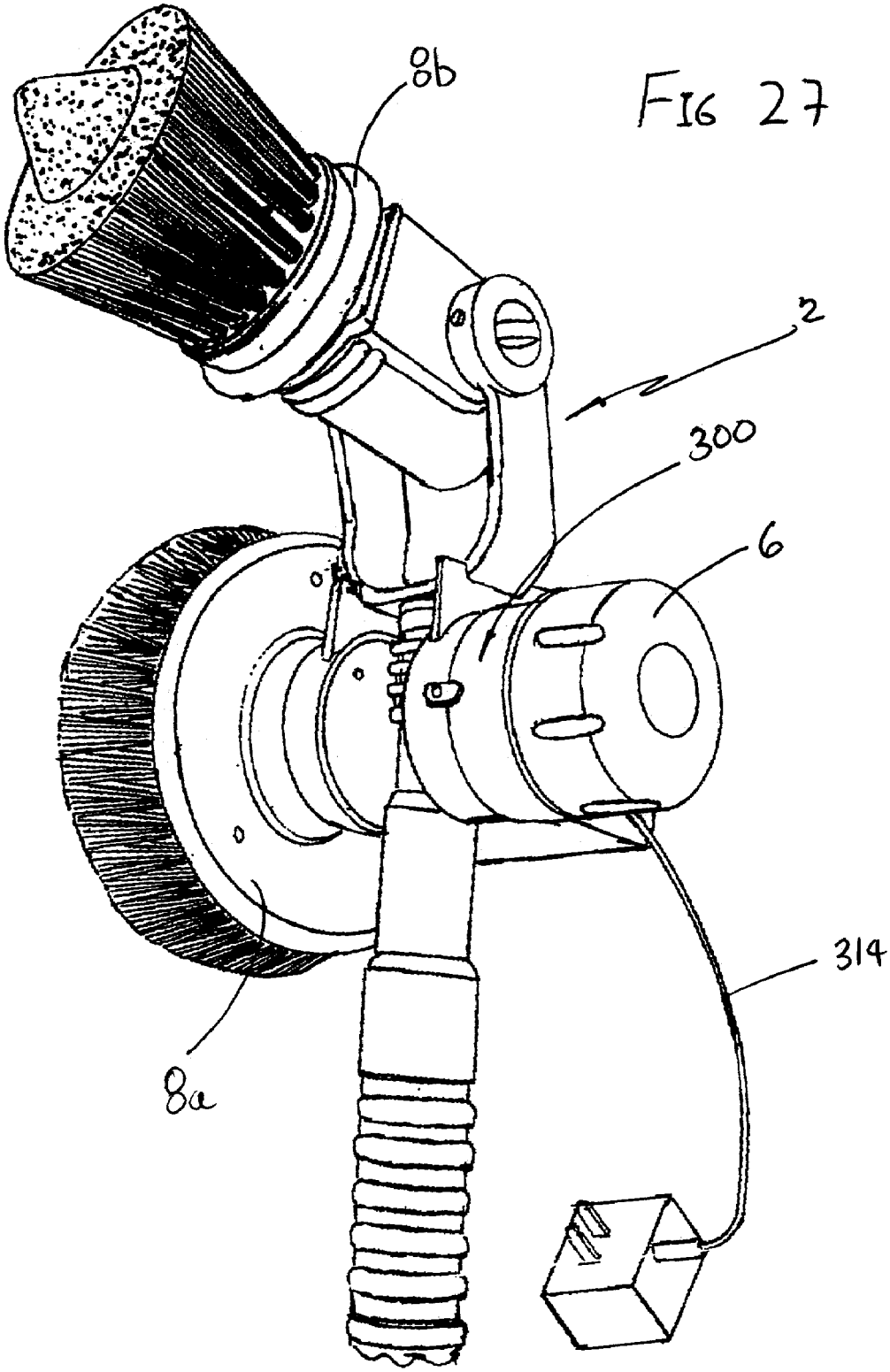
FIG. 27 is a perspective view showing the washer and battery pack in the storage cradle/recharger.
Figure 28:
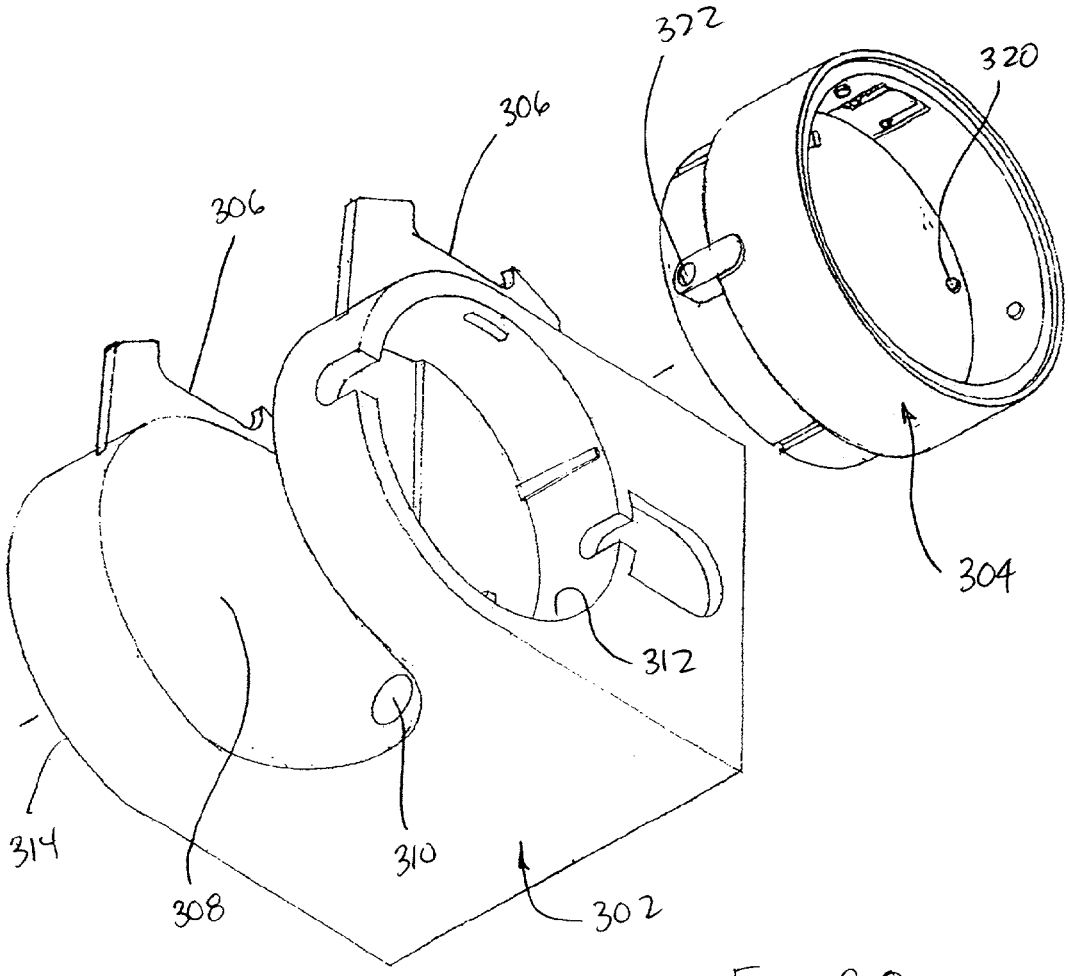
FIG. 28 shows an isometric view of the battery cradle and recharger of FIG. 27.

In that regard, and with reference to FIGS. 27 and 28, a combination storage cradle and charging unit is shown generally at 300 which is comprised of a cradle member 302 and a charging unit 304. As shown in FIG. 28, the cradle 302 includes upper cradle hangers 306 which flank a central slot 308. Thus, it should be appreciated that the cradle 302 can be positioned adjacent to a wall, for example, a wall within a garage, and can be fixed in place by apertures extending through openings 310 of the cradled 302. This allows the battery-powered washer 2 to be hung in place as depicted in FIG. 27. A removable battery recharger 304 is positionable and receivable within an opening 312 of the cradle 302 and in turn has a power cable 314 for connection to an AC voltage source for recharging. The recharger thus has recharging contact members at 320 which contact the contact elements 288*b* and 288*c* of the battery pack 6. Thus, as mentioned, the cradle 300 can be positioned against a wall and the battery 6 can be recharged while the unit is hanging. Alternatively, the user can have an extra rechargeable battery 6 and can leave one of the batteries fixed to the motor drive unit 4 and always have a recharged battery 6 in the recharger unit. It is anticipated that the charger 300 is of the type that recharges the battery to its full capacity, and thereafter is automatically shut off to not further draw power. It is anticipated that the charging unit 304 has an LED readout at 322, which indicates when the unit is charging. However, advantageously, the charging unit 304 is removable from the cradle 302 in the event that the user wishes to use the unit elsewhere and will require the battery charging unit. Although not specifically shown, it is anticipated that the cradle 302 will have a mounting lug extending from side wall 314 which is of a similar profile to that drive lug 30 and extends outwardly such that an alternate brush 8 can be held in place to the cradle.

Thus, it is anticipated that the battery-powered washer is usable in many household cleaning tasks, probably most usable for such items as washing an automobile and thus two brush configurations are included, that is, configurations 8*a* and 8*b*, where a first brush 8*a* is usable for the body, hood, and roof of an automobile, and where a brush such as 8*b* would be usable for areas such as cleaning the wheels or grill of the automobile. Advantageously, the motor drive unit has three different positions relative to the yoke in which it can operate, that is, the selector knob can be placed in two locked positions in which case the motor drive unit has two locked positions relative to the yoke, and one position where the head is free to pivot. It is anticipated that the two locked positions would be angular orientations of the motor drive unit relative to the yoke such that in one position, the hand-held unit could be held with the head down for access to the wheels of the automobile and in another locked position, the unit could be held somewhat horizontally by the elongate handle 10 for washing the sidewalls of an automobile.

Figure 29:
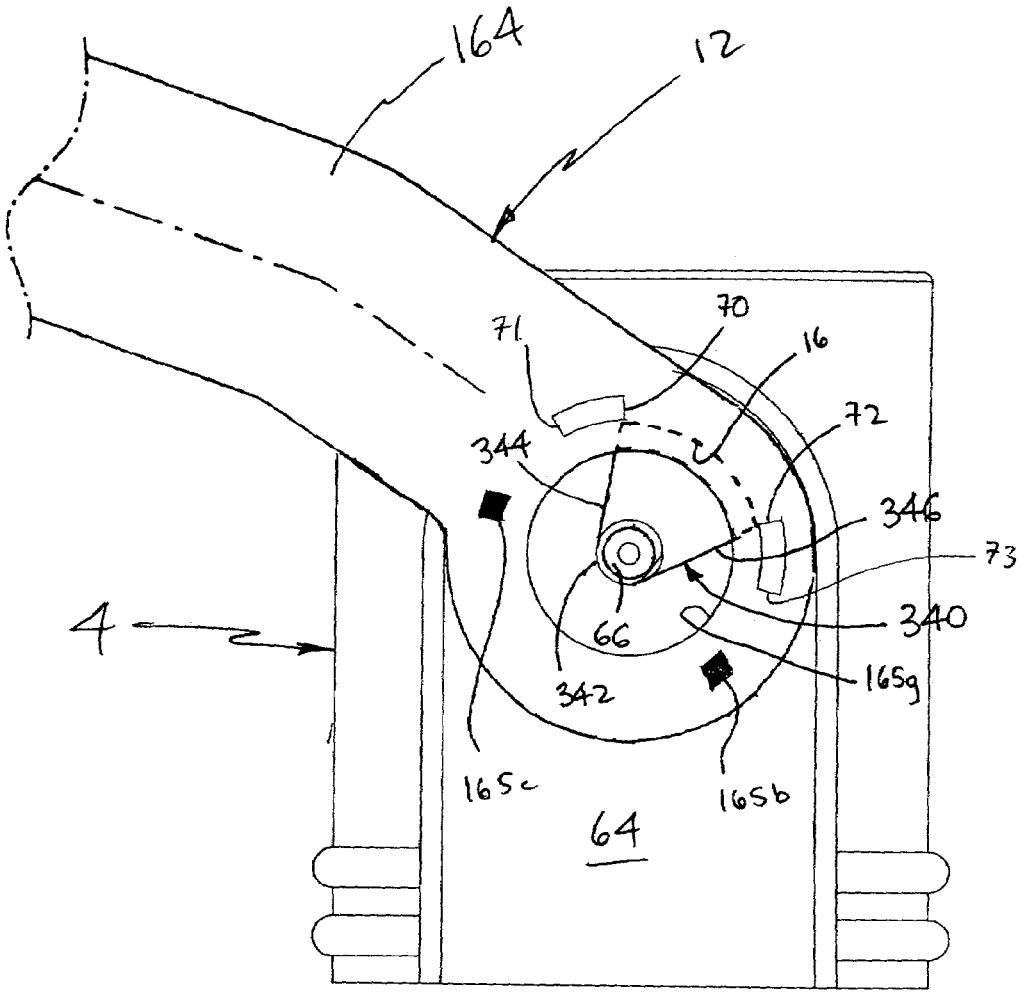
FIGS. 29–31 show diagrammatical views of the detented position and operation of the torsionally spring loaded head.

With respect now to FIGS. 29 through 31, the unlocked position will be described in greater detail, and in particular to the spring-loaded effect of the yoke 12 and head 4. As shown first in FIG. 29, the yoke portion 165 is positioned over the rotational stop 68 such that the rotational stop member 68 is received within the annular opening 165*a* (Figure B). This also places the post 66, which extends from surface 64 of the head 4, through aperture 165*j* of the receiving end 165. A torsional spring 340 having a central wound section 342 is positioned over the post 66 with spring legs 344 and 346 extending therefrom. As shown in FIG. 29, in the neutral position, the opening 165*d* is shown such that the arcuate length of the opening 165*d*, and therefore the arcuate length of the opening 165*f* is the same as the distance between end surfaces 70 and 72 of the radial stop member 68. It should be realized that in this view, and in the views of FIGS. 30 and 31, the stop surfaces 70 through 73 cannot actually be seen, but rather are shown for diagrammatical purposes as it relates to their function with the torsion spring 340.

Thus, in the equilibrium position of FIG. 29, the torsion arm 344 extends from the wound section 342 radially outward through opening 165*f* and into the annular channel 165*a*. Thus, in the neutral position, torsion spring arm 344 extends through opening 165d and is torsionally held against stop member 70, while torsion arm 346 extends through the opening 165*d* and extends into annular channel 165*a* to abut stop surface 72. It should be appreciated that in this position, the torsion spring arm 44 also abuts edge 165*j*, whereas torsion spring arm 346 abuts edge 165*i* (FIG. 13B).

Figure 30:
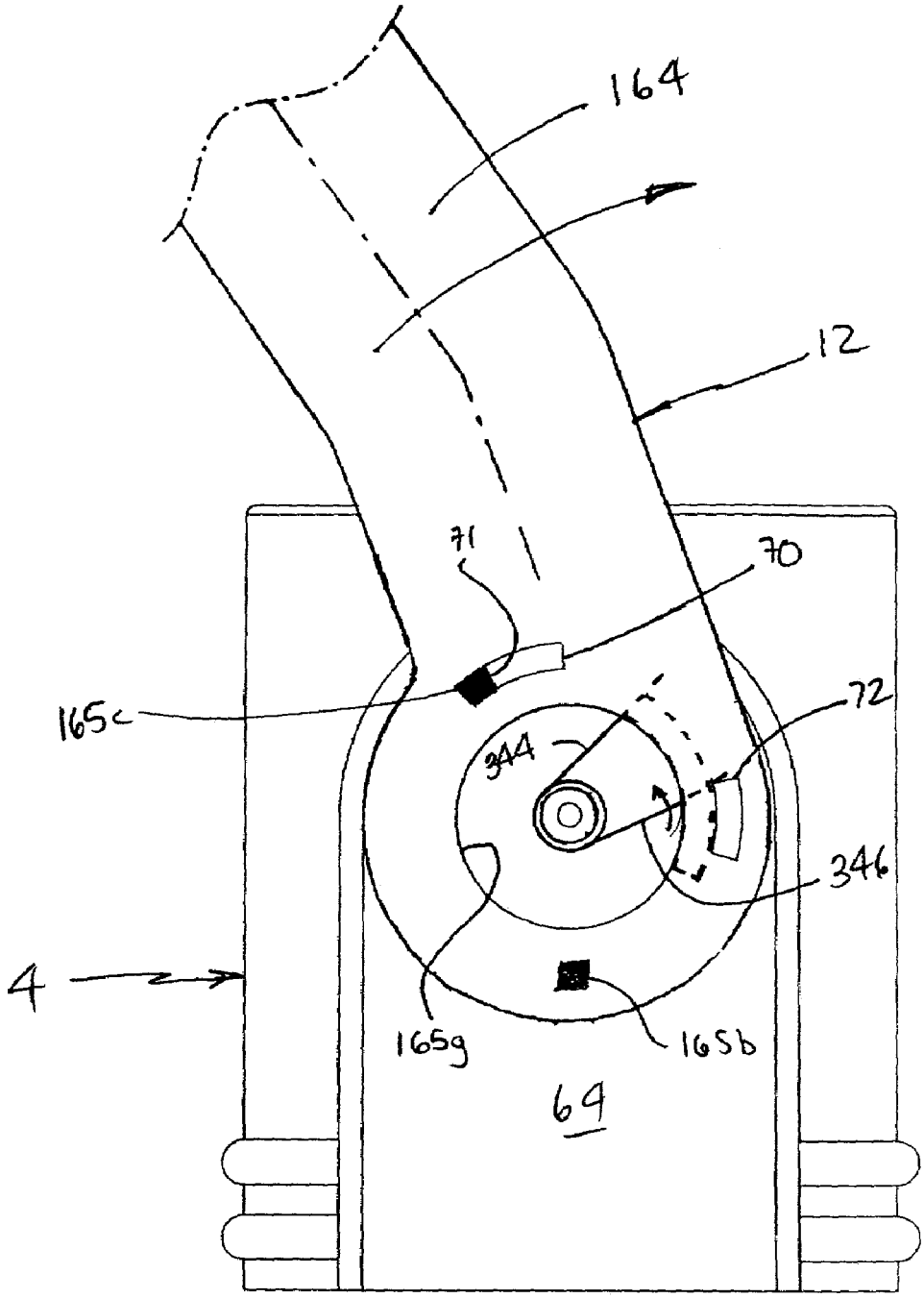

When the arm 164 is moved clockwise relative to head 4 as shown in FIG. 30, stop surface 70 will rotate away from torsion spring arm 344, but the spring arm 344 will remain against the stop edge 165*h*, preventing the rotation of spring arm 344 relative to the yoke 12, however, surface 72 carries spring arm 346 in the counter-clockwise position as viewed in FIG. 30 away from the edge 165*i*.

Figure 31:
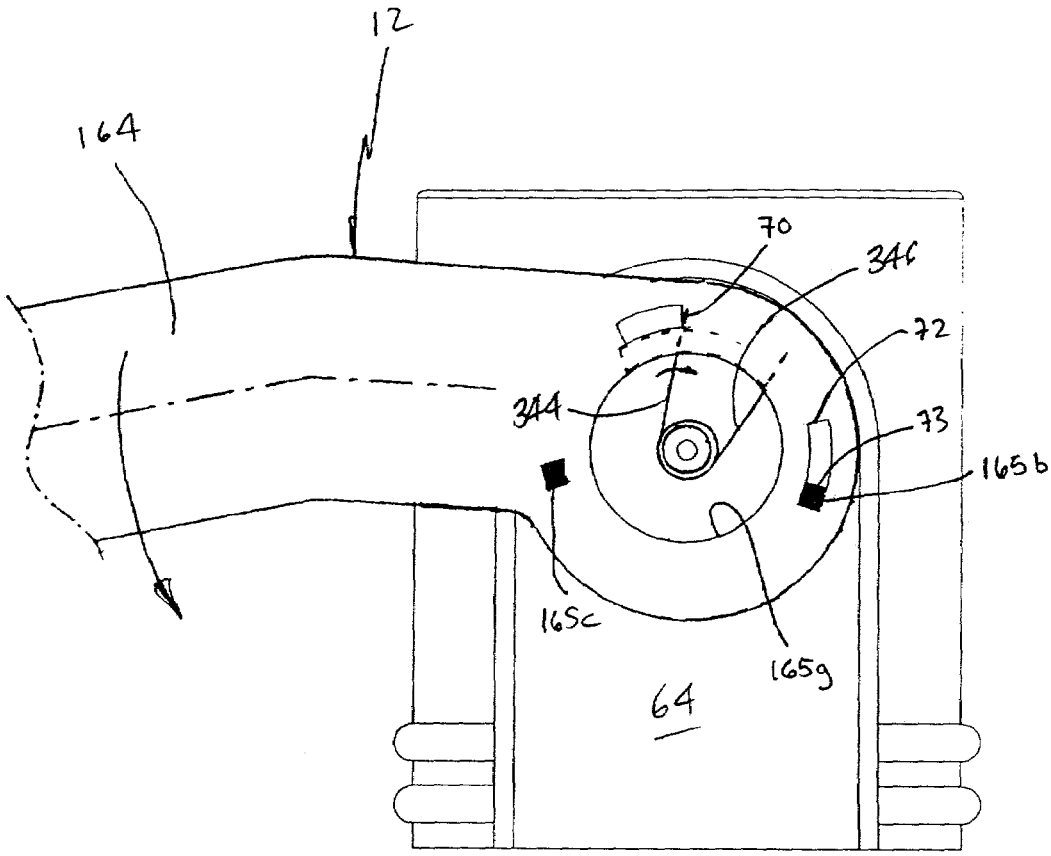

Finally, with respect to FIG. 31, if yoke arm 164 is moved in the counter-clockwise position relative to the head as shown in FIG. 31, the opposite reaction occurs where stop surface 72 is rotated away from the spring arm 346 yet the spring arm 346 is retained by edge 165*i*. Rather the stop surface 70 carries spring arm 344 in the clockwise sense as viewed in FIG. 31. Thus, in either of the positions of FIG. 30 or FIG. 31, the head is floatable between the position where stop surface 73 abuts stop lug 165*b* (FIG. 31) and between the position where a stop surface 71 abuts stop lug 165*c* (FIG. 30). In either of these positions, the torsion spring is torsionally compressed (comparing torsion spring 340 in either of FIGS. 30 or 31 with that of FIG. 29), and thus the head is spring-loaded back to the position of FIG. 29.

Advantageously then the battery-powered washer as described herein has several advantages. Firstly, the battery pack 6 is comprised of a plurality of self-contained and self-sealed batteries where the battery pack is insertable and removable from the washer head for operation or for recharging. It is also the seal itself on the battery pack which seals the internal components of the motor drive unit, and in particular the contact elements 42. Furthermore, the battery pack is self-contained and includes an integral switch for switching directly from the batteries to the motor drive unit, such that a discreet switch, and the required wiring are not included to complicate the assembly. Furthermore, the device is quite useful as it contains two separate locking positions, as well as a free-floating position whereby the head is held in a detented position, but the head is moved between two extremes, but is spring-loaded back to its equilibrium position. Finally, the combination of storage hanger and recharger allows for the unit to be stored and at the same time to have the battery recharged.

The invention claimed is:

1. A hand held washing unit comprising:

a motor drive unit comprising:

a housing having an upper battery receiving cavity and a lower motor receiving cavity, the upper battery receiving cavity forming an open cavity for receipt of a battery pack, a motor received in said lower cavity, electrical contacts positioned within said upper cavity being electrically connected to said motor, a linkage drivingly connected to said motor, and an output drive member connected to said linkage;

an elongate handle connected to said motor drive unit for grasping while in use;

a battery pack having a battery pack housing for receipt of at least one battery, said battery being electrically connected to battery contacts external of said battery pack housing, and said battery pack being receivable in said upper cavity with said battery contacts in alignment with said motor contacts, said battery pack housing, said at least battery and said battery contacts being removable as a unit for recharging; and a switch interconnected between said battery and motor, for switching power between the battery and motor;

whereby, upon installation of said battery pack into said upper cavity, said battery contacts electrically engage said motor contacts, electrically interconnecting said battery to said motor.

2. The hand held washing unit of claim 1, wherein said motor drive axis and said output drive member are aligned along a common axis.

3. The hand held washing unit of claim 2, wherein said upper cavity is in alignment with said common axis, such that said battery is installed along said common axis.

4. The hand held washing unit of claim 1, wherein said battery pack includes a plurality of serially connected batteries connected at opposite poles to said battery contacts.

5. The hand held washing unit of claim 4, wherein said battery pack is comprised of a bi-partite housing comprising an upper housing and lower housing, said bi-partite housing including battery positioning walls therein, and three batteries positioned therein.

6. The hand held washing unit of claim 4, wherein said switch is intermediate said serial connection.

7. The hand held washing unit of claim 6, wherein said switch is installed in said battery pack.

8. The hand held washing unit of claim 7, wherein said battery pack is comprised of a housing member having an upper and lower surface, said battery contacts being positioned on said lower surface, and being receivable within said upper cavity, said switch being positioned within said switch housing member, said battery pack further comprising an actuator for said switch, said actuator extending through said upper surface of said housing member.

9. The hand held washing unit of claim 6, wherein said switch includes a full power position and a partial power position, said partial power position having silicon rectifier diodes in series therewith, for controlling the voltage drop.

10. A hand held washing unit comprising, a motor drive unit comprising a housing having a lower motor receiving cavity, a motor received in said lower cavity, a linkage drivingly connected to said motor, an output drive member connected to said linkage; a battery connected to said motor, a yoke attached to said motor drive unit and an elongate handle connected to said yoke for grasping while in use, said yoke having a locking mechanism cooperable between said yoke and drive unit, said locking mechanism having a plurality of locked positions, locking said motor drive unit in a plurality of positions.

11. The hand held washing unit of claim 10, wherein said yoke has yoke arms flanking said motor drive unit, and said locking mechanism is comprised of a locking ring attached to said motor drive unit, inside one of said yoke arms, and a selector knob cooperable with said locking ring and extending through said yoke arm, said selector knob being rotatable between select positions whereby said knob can be locked to said locking ring and to said yoke arm.

12. The hand held washing unit of claim 11, wherein said cooperation between said selector knob, said locking ring and said yoke arm provides two locked positions and a floating position.

13. A hand held washing unit comprising:

a motor drive unit comprising:

a housing having an upper end and a lower motor receiving cavity, a motor received in said lower cavity, electrical contacts positioned adjacent to said upper end being electrically connected to said motor, a linkage drivingly connected to said motor, and an output drive member connected to said linkage;

an elongate handle connected to said motor drive unit for grasping while in use;

a battery pack connectable to said housing and having battery contacts positionable in electrical connection with said electrical contacts, said battery pack having a battery, housing for receipt of, and enclosing, at least one battery, said battery housing and battery being removable from said housing as a unit;

a seal member positionable between said battery pack and said housing, for sealing the electrical contacts;

a switch interconnected between said battery and motor, for switching power between the battery and motor; and whereby, upon installation of said battery pack into said upper cavity, said battery contacts electrically engage said motor contacts, electrically interconnecting said battery to said motor, and said battery contacts and said electrical contacts are sealed.

14. The hand held washing unit of claim 13, wherein said housing upper end is defined as a cavity for receiving at least a part of said battery pack.

15. The hand held washing unit of claim 14, wherein said motor drive axis and said output drive member are aligned along a common axis.

16. The hand held washing unit of claim 15, wherein said cavity is annular in shape and said battery pack has a reduced cross sectional area received in said cavity, said seal being positioned around said battery pack to engage an interface between said battery pack and said housing.

17. The hand held washing unit of claim 16, wherein said upper cavity is in alignment with said common axis, such that said battery is installed along said common axis.

18. The hand held washing unit of claim 13, wherein said battery pack includes a plurality of serially connected batteries connected at opposite poles to said battery contacts.

19. The hand held washing unit of claim 18, wherein said battery pack is comprised of a bi-partite housing comprising an upper housing and lower housing, said bi-partite housing including battery positioning walls therein, and three batteries positioned therein.

20. The hand held washing unit of claim 19, wherein said switch is intermediate said serial connection.

21. The hand held washing unit of claim 20, wherein said switch is installed in said battery pack.

22. The hand held washing unit of claim 21, wherein said battery pack is comprised of a housing member having an upper and lower surface, said battery contacts being positioned on said lower surface, and being receivable within said upper cavity, said switch being positioned within said switch housing member, said battery pack further comprising an actuator for said switch, said actuator extending through said upper surface of said housing member.

23. The hand held washing unit of claim 13, wherein said switch includes a full power position and a partial power position, said partial power position having silicon rectifier diodes in series therewith, for controlling the voltage drop.

* * * * *